US010041755B1

(12) United States Patent
Langdon et al.

(10) Patent No.: US 10,041,755 B1
(45) Date of Patent: Aug. 7, 2018

(54) SAFETY WRIST STRAP FOR A CROSSBOW CRANK HANDLE

(71) Applicant: Excalibur Crossbow, Inc., Kitchener (CA)

(72) Inventors: Stephen Donald Langdon, Arthur (CA); Benjamin Dean Blosser, Corydon, KY (US)

(73) Assignee: EXCALIBUR CROSSBOW, INC., Kitchener (CA)

( * ) Notice: Subject to any disclaimer, the term of this patent is extended or adjusted under 35 U.S.C. 154(b) by 0 days.

(21) Appl. No.: 15/788,779

(22) Filed: Oct. 19, 2017

(51) Int. Cl.
*F41B 5/12* (2006.01)
*F41B 5/14* (2006.01)

(52) U.S. Cl.
CPC ..... *F41B 5/12* (2013.01); *F41B 5/1473* (2013.01)

(58) Field of Classification Search
CPC ..... A45C 2013/303; A45F 2005/008; F41B 5/12; F41B 5/1473; F41B 5/1476; F41B 5/148
See application file for complete search history.

(56) References Cited

U.S. PATENT DOCUMENTS 774,143 A * 11/1904 Adams ..... A45F 5/00 224/220
4,831,997 A * 5/1989 Greene ..... F41B 5/1473 124/35.2
5,131,095 A * 7/1992 D'Amato ..... F41B 5/1473 2/21
5,845,337 A * 12/1998 Smith ..... A41D 13/085 2/158
8,453,632 B2 * 6/2013 Immesberger ..... F41B 5/1461 124/1
2014/0283810 A1 * 9/2014 Rowe ..... F41B 5/1469 124/86

* cited by examiner

*Primary Examiner* — John Ricci
(74) *Attorney, Agent, or Firm* — David S. Alavi

(57) ABSTRACT

A safety device for a crossbow includes a wrist strap with a crank aperture in a palm portion thereof, and is secured around a user's wrist with the crank aperture over the palm of the user's hand. The crank aperture allows passage therethrough of a shaft of a crossbow crank, but prevents passage of a handle; wearing the wrist strap, the user can grasp the handle with the shaft extending through the crank aperture away from the palm of the user's hand. The wrist strap can be divided at its dorsal-wrist portion and include a closure to allow the wrist strap to be secured around or removed from the user's wrist as desired. Restraint of the crank handle by the crank aperture prevents uncontrolled spinning of the crossbow crank.

21 Claims, 7 Drawing Sheets

SAFETY WRIST STRAP FOR A CROSSBOW CRANK HANDLE

FIELD OF THE INVENTION

The field of the present invention relates to crossbows. In particular, an inventive safety wrist strap for a crossbow crank handle, and methods of use thereof, are disclosed herein.

BACKGROUND

A crossbow is designed to fire a bolt at velocities significantly larger than those achievable using a so-called vertical bow. The greater energy storage in the limbs of the crossbow requires larger draw weights; drawing the crossbow against those larger draw weights usually requires some sort of draw mechanism to assist the user (i.e., an arbalist or crossbowman) to draw the crossbow. Over the centuries many different techniques, devices, and arrangements have been devised for drawing a crossbow. Examples include, but are not limited to, hand-spanning, belt hook, rope and pulley, pushing or pulling levers, latchet, windlass or winch, lead screw, or cranequin.

One of many examples of a crossbow drawn by a winch mechanism is disclosed in U.S. non-provisional application Ser. No. 15/784,138 filed Oct. 15, 2017, which is incorporated by reference as if fully set forth herein. An example of such a crossbow 10 is shown in FIGS. 5 and 6 in undrawn (brace) and drawn arrangements, respectively, and includes a stock 20, an elongated mainframe 12, bow limbs 30, a bowstring 50, stationary and reciprocating trigger subassemblies 200 and 300 (respectively), and the winch mechanism 400. A crossbow crank includes a handle 420, a shaft 440, and an arm 450. The crank is attached to the winch mechanism 400 and used to operate the winch mechanism 400 to draw the crossbow 10 to its drawn arrangement (e.g., as in FIG. 6) and, in some instances, to allow the crossbow 10 to return to its undrawn, brace arrangement (e.g., as in FIG. 5) in a controlled manner without firing the crossbow 10. Operating the winch mechanism 400 to draw the crossbow 10 causes a rope 16 to be taken up by a spool of the winch mechanism 400, which in turn pulls the reciprocating trigger subassembly 200 (and the bowstring 50 held by it) rearward along a mainframe 12 of the crossbow 10. The winch mechanism 400 includes a clutch that, when it is engaged, only permits the winch mechanism 400 to take up the rope 16; the clutch does not permit the rope 16 to be let out unless the clutch is disengaged. In the drawn arrangement, the reciprocating trigger subassembly 200 and the stationary trigger subassembly 300 are relatively positioned to allow the crossbow 10 to be triggered and a bolt to be launched from it. Further details of the arrangement of the example crossbow 10 are not pertinent to the present disclosure, and are not elaborated upon herein. The crank typically can be detached from and reattached to the winch mechanism 400, so that it can be moved out of the way when not in use (e.g., after drawing the crossbow and while aiming and firing it).

The mechanical advantage provided by the winch mechanism 400 and the crank enable the user to draw the crossbow 10 against the large draw force. The clutch, when engaged, typically prevents the tension in the bowstring 50 from pulling forward the reciprocating trigger subassembly 200. After firing the crossbow 10, the clutch is disengaged by the user to allow the reciprocating trigger subassembly 200 to be moved forward to prepare for the next shot. The mechanical advantage also enables the user to let the crossbow 10 return to its brace arrangement in a controlled manner (without being fired; also referred to as decocking the crossbow 10), by resisting the force exerted by the bowstring 50. Such decocking requires disengagement of the clutch.

The mechanical advantage described above, that permits use of the crossbow 10 despite the large draw force, also can result in the winch mechanism 400 and crank (if not properly controlled by the user) being spun very rapidly in response to the force exerted by the bowstring 50. For example, if the clutch is erroneously disengaged during or after drawing the crossbow 10, while the user is not holding the crank handle 420, there is nothing to prevent the tension on the bowstring 50 from pulling the reciprocating trigger subassembly 200 forward, pulling the rope 16 off of the spool of the winch mechanism 400, and causing the winch mechanism 400 and the crank handle to spin. In another example, if the user's hand should slip off of the crank handle 420 during decocking of the crossbow 10 (while the clutch is disengaged), a similar uncontrolled spin can occur. During such uncontrolled spins, the energy stored in the deformed bow limbs 30, which during a normal shot would be transferred to the launched bolt as translational kinetic energy, is instead at least partly transferred to the winch mechanism 400 and the crank as rotational kinetic energy. The uncontrolled spinning can cause damage to the crossbow 10; a potential might exist for injury to the user as well, particularly his hand or fingers. If the spinning causes the crank to detach and fly off, other damage or injuries potentially could result.

SUMMARY

An inventive safety device for a crossbow comprises a wrist strap and a crank aperture formed in a palm portion of the wrist strap. The wrist strap is arranged so as to be secured around a user's wrist with the crank aperture positioned over the palm of the user's hand. The crank aperture is sized and positioned so that a shaft of a crossbow crank can pass through, but a handle cannot, and with the wrist strap secured around the user's wrist, the user can grasp the handle with the shaft extending through the crank aperture away from the palm of the user's hand. The wrist strap can include a dorsal-wrist portion that is divided into separate strap segments, with the separate strap segments arranged to be connected, disconnected, and reconnected so that the wrist strap can be secured around the user's wrist or removed from the user's wrist as desired.

To use the wrist strap while drawing a crossbow, the user secures the wrist strap around his wrist, with the crank aperture positioned over the palm of his hand. With the shaft of the crossbow crank passing through the crank aperture, the user then attaches the arm of the crossbow crank to the winch mechanism of the crossbow. The user can then (i) grasp the handle, with the handle positioned against his palm and the shaft extending through the crank aperture away from his palm, and (ii) use the crossbow crank to operate the winch mechanism to draw the crossbow. After drawing the crossbow, the user can release the crank handle and then aim and trigger the crossbow to launch a bolt (with or without detaching the crank from the winch mechanism). Instead of firing the crossbow, the user can grasp the handle (with the strap secured around his wrist, with the handle against his palm, with the shaft extending through the crank aperture, and with the arm attached to the winch mechanism) and use the crank to operate the winch mechanism to allow the crossbow to return to its undrawn (brace) arrangement.

Objects and advantages pertaining to safety devices for crossbows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
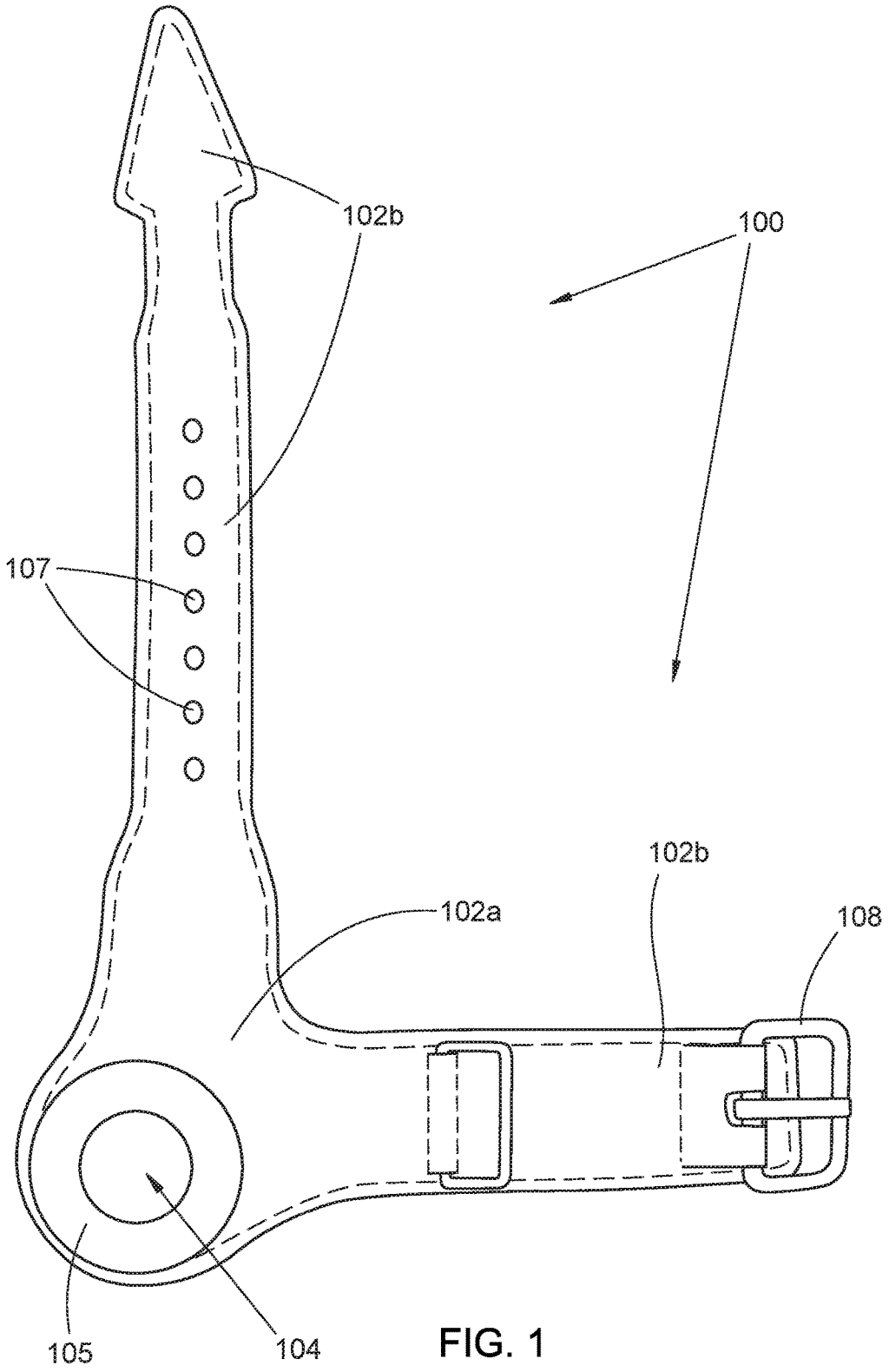
FIG. 1 illustrates schematically an inventive safety wrist strap laid out flat.
Figure 2:
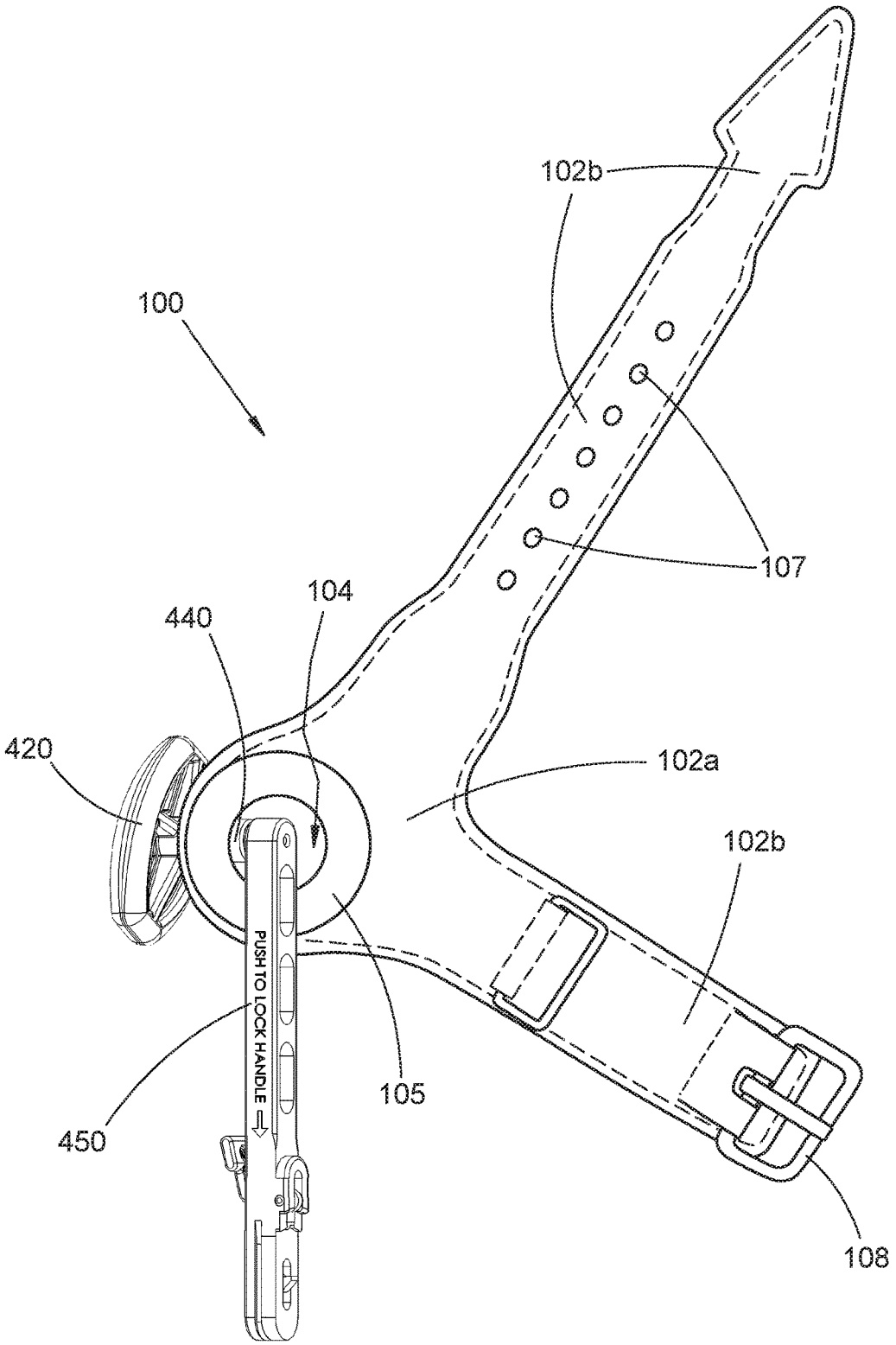
FIG. 2 illustrates schematically the inventive wrist strap laid out flat with a crossbow crank positioned with a shaft thereof passing through a crank aperture of the wrist strap.
Figure 3:
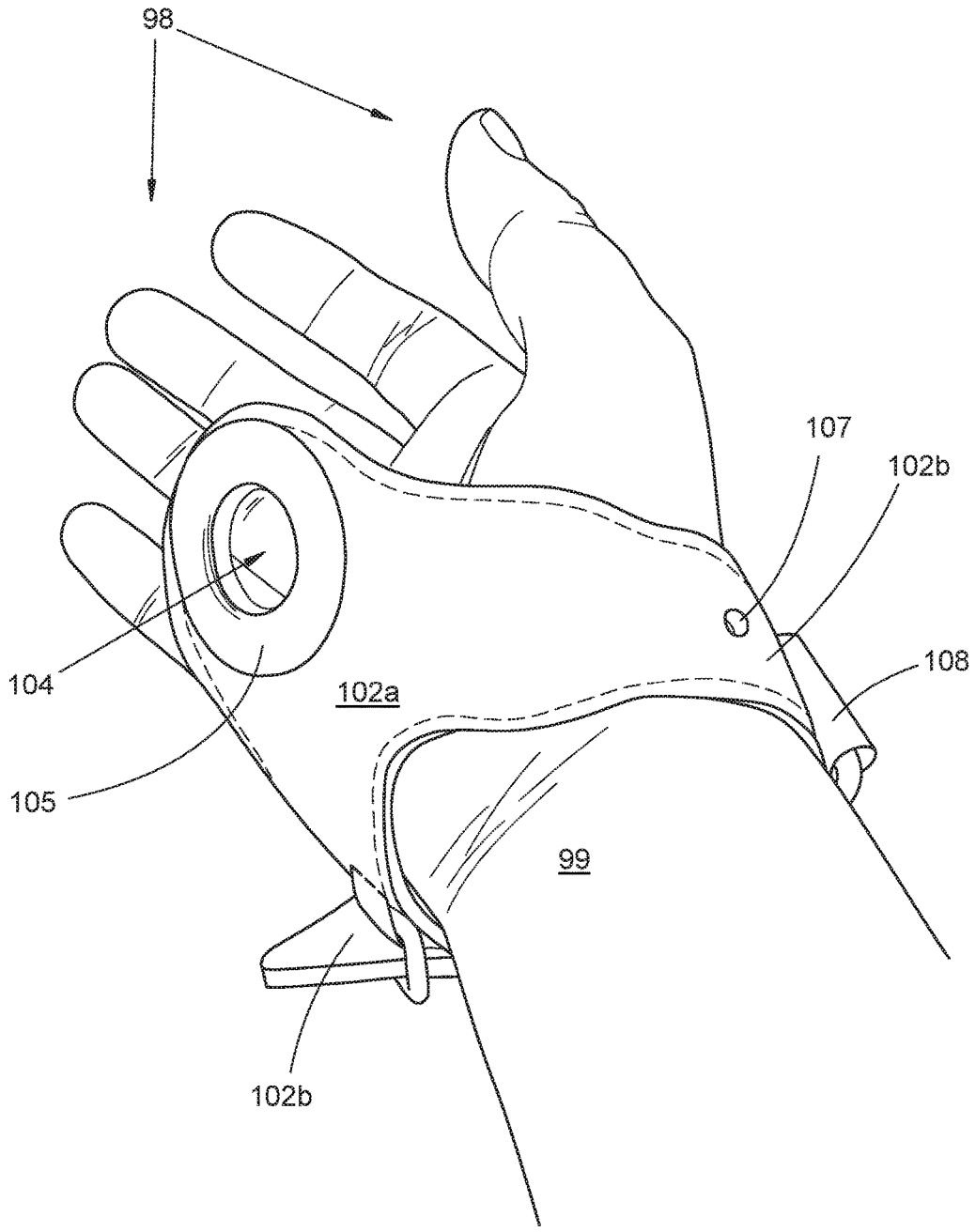
FIG. 3 illustrates schematically the inventive wrist strap secured around a user's wrist.
Figure 4:
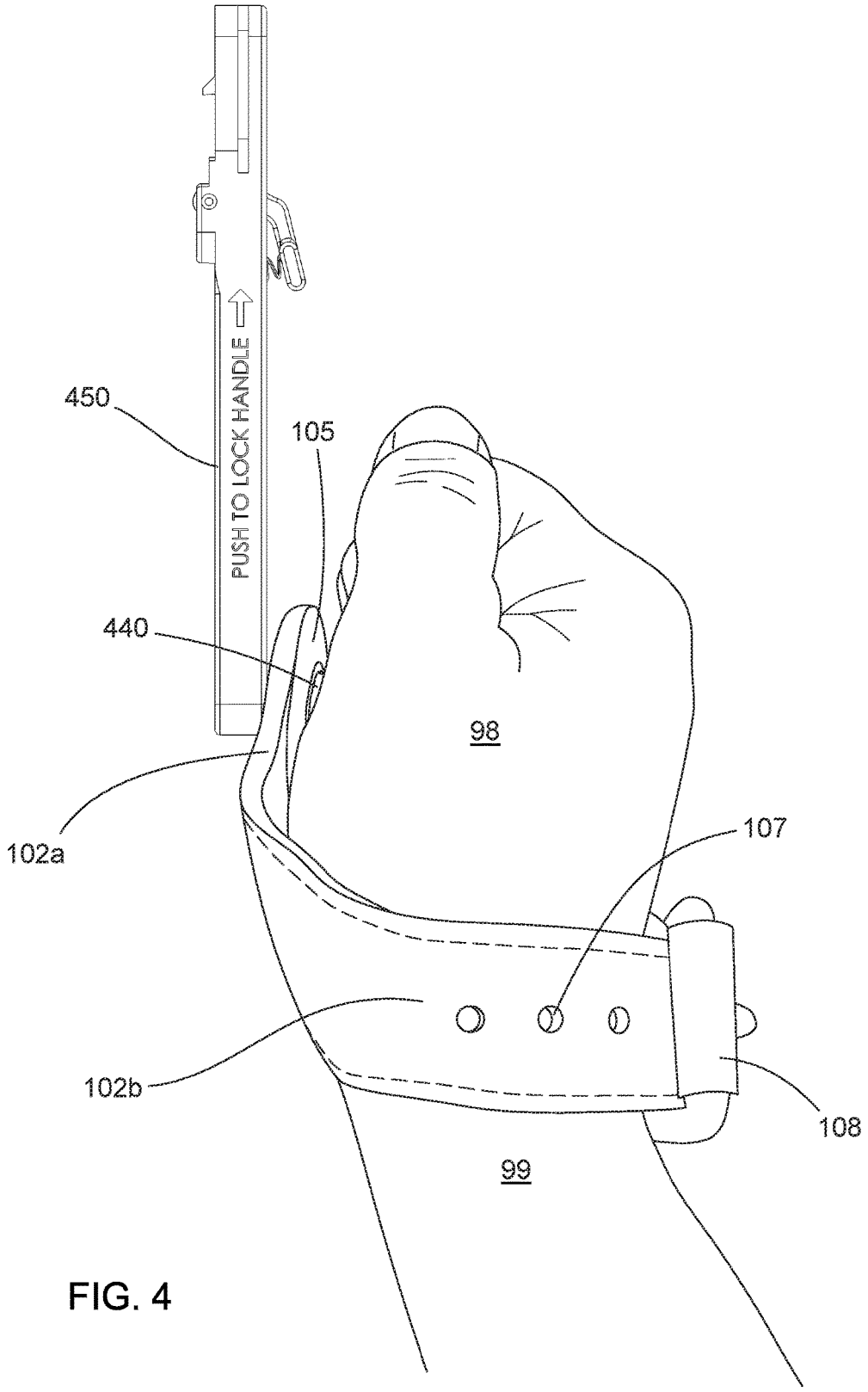
FIG. 4 illustrates schematically the inventive wrist strap secured around a user's wrist while the user grasps the handle of the crank with the shaft of the crank extending through the crank aperture away from the palm of the user's hand.

The embodiments depicted are shown only schematically. All features may not be shown in full detail or in proper proportion, certain features or structures may be exaggerated relative to others for clarity, and the drawings should not be regarded as being to scale. The embodiments shown are only examples; they should not be construed as limiting the scope of the present disclosure or appended claims.

DETAILED DESCRIPTION OF EMBODIMENTS

An inventive safety device is illustrated schematically in FIGS. 1-4 and comprises a wrist strap 100 and a crank aperture 104 formed in a palm portion 102*a* of the wrist strap 100. The wrist strap 100 can be made of any suitable one or more sufficiently flexible materials or fabrics that are also sufficiently strong to bear the loads encountered. Examples of suitable material can include, but are not limited to, natural or artificial leather, one or more fabrics made up of one or more types of natural or synthetic fibers (e.g., canvas or ballistic nylon), one or more polymeric materials (e.g., polyvinyl chloride or polyethylene), and so forth; natural or artificial leather is a common material for the wrist strap 100. The wrist strap 100 is arranged in any suitable way to be secured around a user's wrist 99 with the crank aperture 104 positioned over the palm of the user's hand 98 (e.g., as in FIGS. 3 and 4). In some examples the wrist strap 100 can comprise a closed loop that is pulled on over the user's hand 98 to be secured around his wrist 99; an elastic material for the wrist strap 100 can be advantageously employed in such examples. In some other more common examples, a dorsal-wrist portion 102*b* of the wrist strap 100 is divided into separate strap segments, and those separate strap segments are arranged so as to be (i) connected together to secure the wrist strap around the user's wrist 99 (e.g., as in FIGS. 3 and 4), and (ii) disconnected from one another to enable removal of the wrist strap from the user's wrist 99 (e.g., as in FIGS. 1 and 2). A closure mechanism typically is employed to enable repeated connecting and disconnecting of the strap segments. A frame-and-prong-type buckle 108 is employed in the example shown, employing the holes 107 in the strap portion 102*b*; other suitable closure mechanisms can be employed, including but not limited to a friction-type buckle, a ratchet-type buckle, a clasp, a hook-and-loop-type fastener (e.g., Velcro®), snaps, buttons, ties, and so forth.

The crossbow crank includes a handle 420, a shaft 440 connected to the handle 420, and an arm 450 connected to the shaft 440. The arm 450 is rotatable relative to the handle 420 about an axis defined by the shaft 440, and can be attached to and detached from the winch mechanism 400. When attached, the arm 450 is rotatable about an axis defined by the winch mechanism 400; rotation of the crank about that axis operates the winch mechanism 400 to take up the rope 16 (when rotated in one direction) or to let out the rope 16 (when rotated in the other direction). The axis defined by the shaft 440 is substantially parallel to and offset from the axis defined by the winch mechanism 400.

The crank aperture 104 is positioned on the palm portion 102*a* of the wrist strap 100 and sized so that the shaft 440 can pass through, but the handle 420 cannot. In some examples, the crank aperture 104 is sized or arranged so as to enable passage therethrough of the arm 450 (e.g., as in FIGS. 2 and 7A); in some other examples, the crank aperture 104 is sized or arranged so as to prevent passage therethrough of the arm 450 (e.g., as in FIGS. 7B-7F). In the former case, the wrist strap 100 and the crossbow crank can be separated from one another as needed or desired by the user, by withdrawing the shaft 440 and the arm 450 from the crank aperture 104; the crossbow crank and the wrist strap 100 can be reassembled by insertion of the arm 450 and the shaft 440 through the crank aperture 440. In the latter case, the wrist strap 100 and the crossbow crank remain attached to one another during routine use; removal of the crossbow crank from the wrist strap 100 typically would require at least partial disassembly of the crossbow crank (e.g., removal of the handle 420 or the arm 450 from the shaft 440, or disassembly of the shaft 440).

In some examples, the crank aperture 104 is defined by a substantially rigid grommet 105 attached to the palm portion 102*a* of the wrist strap 100. The grommet 105 can be made of any one or more suitably strong and rigid solid materials; examples include but are not limited to sufficiently rigid metallic or polymeric materials. In some examples (e.g., as in FIGS. 2 and 7A) the grommet 105 is large enough to permit passage of both the shaft 440 and the arm 450; in other examples (e.g., as in FIGS. 7B, 7E, and 7F), the grommet 105 is large enough to permit passage of the shaft 440 (or a portion thereof) but small enough to prevent passage of the arm 450. The rigidity of the grommet 105 can ensure that deformation of the flexible strap material does not permit unwanted passage of the handle 420 (and in some examples, the arm 450) through the crank aperture 104. With the wrist strap 100 secured around the user's wrist 99, the user can grasp the handle 420 with the shaft 440 extending through the crank aperture 104 and the grommet 105 away from the palm of the user's hand 98 (e.g., as in FIG. 4).

Figures 7A, 7B, 7C, 7D, 7E, 7F:
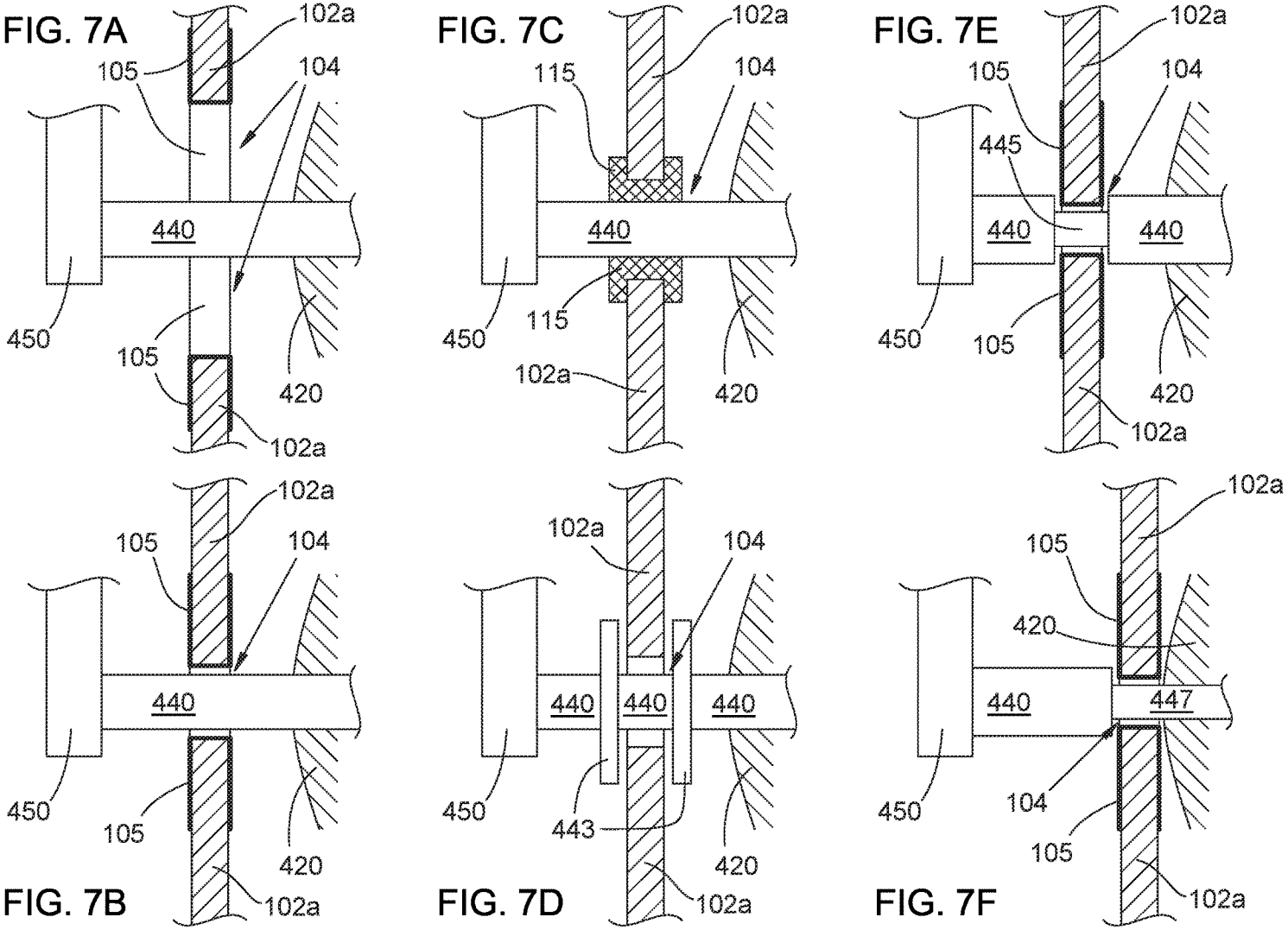
FIGS. 7A through 7F illustrate schematically various arrangements of the shaft of the crossbow crank engaged with the crank aperture of the wrist strap.

In the example of FIG. 7C, a bushing 115 is attached to the palm portion 102*a* of the wrist strap 100 and defines the crank aperture 104. The bushing 115 receives the shaft 440 therethrough and rotatably engages the shaft 440. The bushing 115 does not permit passage of the handle 420 or the arm 450, and retains the crossbow crank attached to the wrist strap 100. The bushing 115 can be secured to the palm portion 102*a* of the wrist strap 100 in any suitable way.

Typically, removal of the crossbow crank from the wrist strap 100 would require removal of the handle 420 or the arm 450 from the shaft 440 before sliding the shaft 440 out of the bushing 115. In some examples the material of the wrist strap 100 is sufficiently stiff so as to retain the bushing 115 in place (e.g., as in FIG. 7C); in some examples a grommet can be employed between the palm portion 102*a* and the bushing 115, if needed or desired (not shown). In the example of FIG. 7D, a pair of flanges 443 on the shaft 440 retain the shaft 440 within the crank aperture 104. The flanges 443 do not permit removal of the shaft 440, thereby retaining the crossbow crank attached to the wrist strap 100. Typically, removal of the crossbow crank from the wrist strap 100 would require disassembly of the shaft 440 to separate the flanges 443 and release the wrist strap 100. In some examples the material of the wrist strap 100 is sufficiently stiff so as to prevent passage of the flanges 443 through the crank aperture 104 (e.g., as in FIG. 7D); in some examples a grommet can be employed on the palm portion 102*a* to prevent passage of the flanges 443, if needed or desired (not shown).

In the example of FIGS. 7E and 7F, the inner edge of the crank aperture 104 is received within a circumferential groove on the shaft 440. In the example of FIG. 7E, a groove 445 is bounded by two larger-diameter segments of the shaft 440, which are too large to pass through the crank aperture 104. In the Example of FIG. 7F, the "groove" is formed by a reduced-diameter segment 447 of the shaft 440 entering the handle 420. The reduced-diameter segment 447 passes through the crank aperture 104, but the larger diameter segment of the shaft 440 is too large to pass through the crank aperture 104. The inner edge of the crank aperture 104 is received between the larger-diameter segment of the shaft 440 and the handle 420. Typically, removal of the crossbow crank from the wrist strap 100 would require disassembly of the shaft 440 or removal of the handle 420 to enable removal of the crank aperture 104 from the groove; any suitable construction of the shaft 440 or handle 420 can be employed, e.g., shoulder screws, spacers, and so forth. In some examples the material of the wrist strap 100 is sufficiently stiff so as to prevent passage of the larger-diameter segment of the shaft 440 through the crank aperture 104 (not shown); in some examples a grommet can be employed on the palm portion 102*a* to prevent passage of the larger-diameter segments of the shaft 440 through the crank aperture 104, if needed or desired (e.g., as in FIGS. 7E and 7F).

Figure 5:
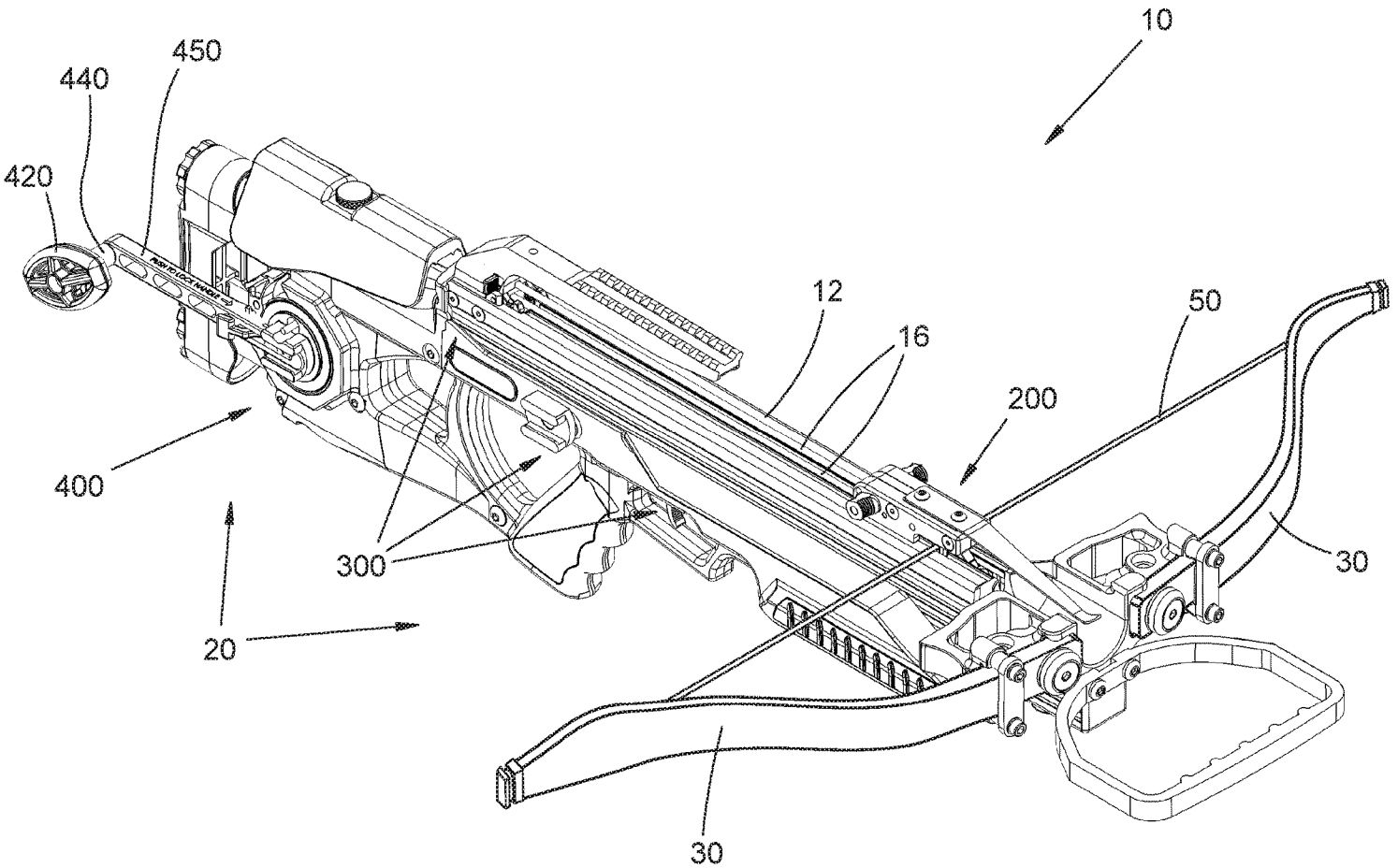
FIG. 5 illustrates an example of a winch-drawn crossbow at brace (undrawn).
Figure 6:
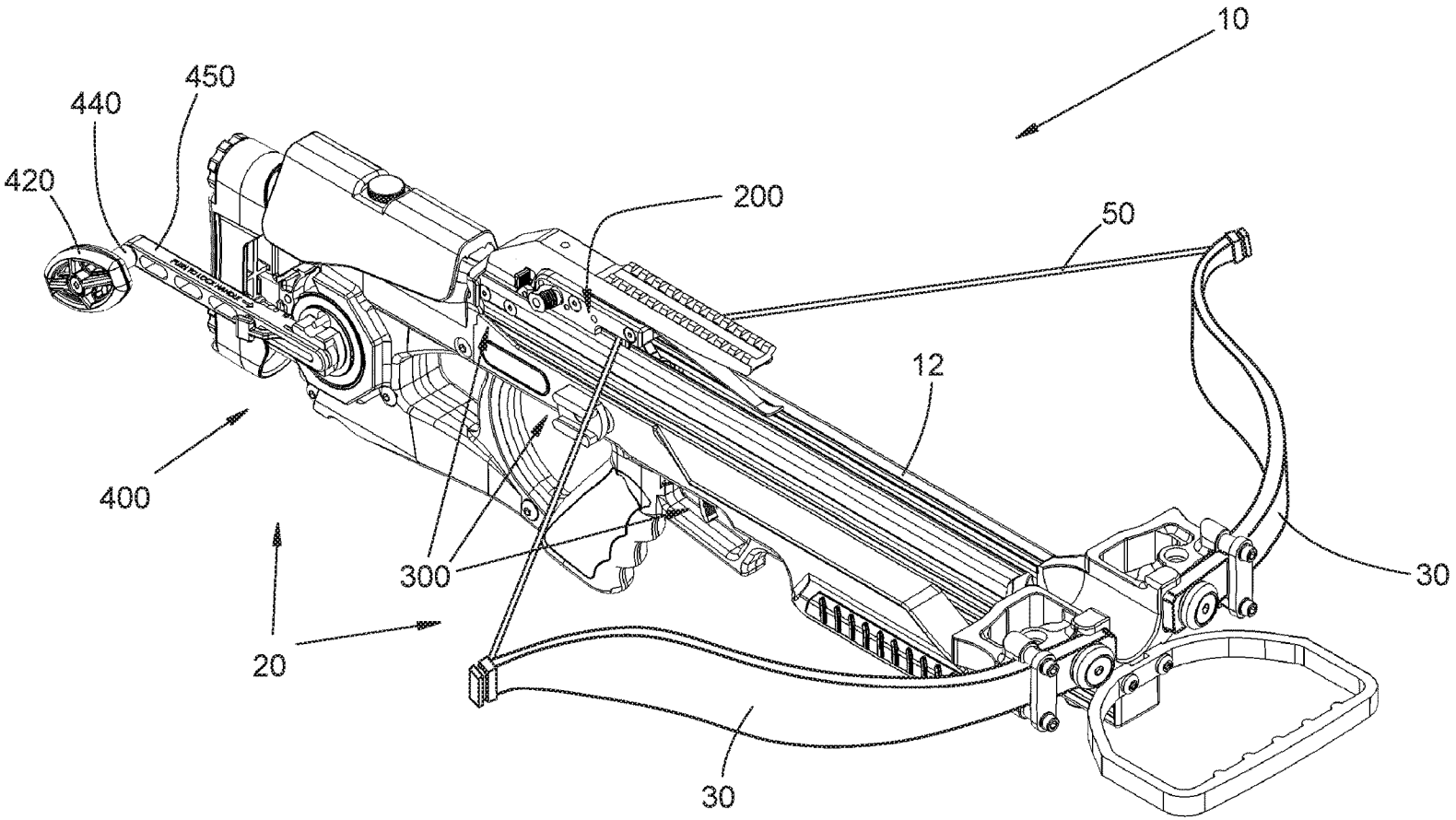
FIG. 6 illustrates the example of the winch-drawn crossbow at full draw.

The inventive safety device of any one of FIGS. 1-4 and 7A-7F can be used with the example crossbow 10 shown in FIGS. 5 and 6 and described above; however, the present disclosure and appended claims can be applicable to any winch-drawn crossbow, in addition to the example shown in the drawings.

To use the inventive safety device to operate a winch-driven crossbow (e.g., the crossbow 10), the user first secures the wrist strap 100 around his wrist 99 with the crank aperture 104 positioned over the palm of his hand 99 and with the shaft 440 of the crossbow crank extending through the crank aperture 104 away from the user's palm. If the crank aperture 104 is large enough to permit passage of the arm 450, the arm 450 and shaft 440 can be inserted through the crank aperture before or after the wrist strap 100 is secured around the user's wrist, as convenient or desired. The wrist strap 100 typically is sufficiently flexible that the arm 450 and shaft 440 can pass through the crank aperture 104, and the handle 420 placed against the user's palm, after the wrist strap 100 is secured around the user's wrist 99. If the wrist strap 100 is too stiff, or if the user finds it too uncomfortable, or for any other reason, or for no particular reason, the arm 450 and the shaft 440 can instead be inserted through the crank aperture 104 before securing the wrist strap 100 around the user's wrist 99.

Next, the user attaches the arm 450 to the crank mechanism 400 of the crossbow 10, after which he can grasp the handle 420 and use the crossbow crank to operate the winch mechanism 400 to draw the crossbow 10 (i.e., to move the reciprocating trigger subassembly 200 and the bowstring 50 rearward along the mainframe 12, so that the crossbow 10 moves from the undrawn arrangement of FIG. 5 to the drawn arrangement of FIG. 6). With the crossbow 10 held in the drawn arrangement of FIG. 6 (e.g., by engagement of a clutch in the winch mechanism 400, if present; by tension on the rope 16; by a trigger latch of any suitable type or arrangement, if present; or by other means), the user can release the handle 420. After loading a bolt (not shown), the user can aim and trigger the crossbow 10 to launch the bolt.

With the wrist strap 100 secured around the user's wrist 99 and the handle 420 unable to pass through the crank aperture 104, the hazards described above are substantially eliminated. Even if the user releases the handle 420 (intentionally or unintentionally), the winch mechanism 400 and the crank handle can only rotate through a partial rotation before being obstructed by the shaft 440 extending through the crank aperture 104, which is in turn restrained by the wrist strap 100 being secured to the user's wrist 99; the winch mechanism 400 and the crank handle therefore cannot spin uncontrolledly in response to tension on the bowstring 50 transmitted through the subassembly 200 and the rope 16. For example, if the clutch is erroneously disengaged during or after drawing the crossbow 10, while the user is not holding the crank handle 420, retention of the handle 420 by the crank aperture 104 prevents the tension on the bowstring 50 from pulling the reciprocating trigger subassembly 200 forward, so there is no uncontrolled spin of the winch mechanism 400 and the crossbow crank. In another example, if the user's hand should slip off of the crank handle 420 during decocking of the crossbow 10 (while the clutch is disengaged), the restraint of the handle 420 by the crank aperture 104 similarly prevents an uncontrolled spin of the winch mechanism 400 and the crossbow crank. Even if the crossbow 10 lacks a clutch in the winch mechanism 400, restraint of the shaft 440, and retention of the handle 420, by the crank aperture 104 prevents an uncontrolled spin. Without any uncontrolled spinning of the crank, the hazards described above are avoided.

In many examples, after releasing the handle 420 but before aiming and firing the crossbow 10, the user detaches the crossbow crank from the winch mechanism 400, to keep it out of the way. In examples wherein the arm 450 cannot pass through the crank aperture 104, the crossbow crank remains suspended from the wrist strap 100 while the user aims and shoots the crossbow 10. In examples wherein the arm 450 can pass through the crank aperture 104, depending on the preference of the user, the crossbow crank can remain suspended from the wrist strap 100 while the user aims and shoots the crossbow 10. Alternatively, after detaching the arm 450 from the winch mechanism 400, the user can also withdraw the shaft 440 and the arm 450 of the crossbow crank from the crank aperture 104 and remove the crossbow crank from the wrist strap 100 entirely before aiming and firing the crossbow.

To decock the drawn crossbow 10 (i.e., to allow the crossbow 10 to move from the drawn arrangement of FIG. 6 to the undrawn (brace) arrangement of FIG. 5, without launching a bolt), the user grasps the handle 420 (with the wrist strap 100 secured around his wrist 99) with the handle 420 positioned against his palm and the shaft 440 extending through the crank aperture 104 away from his palm. The user then uses the crossbow crank to operate the winch mechanism 400 to decock the crossbow 10. If the crossbow 10 includes a clutch in the winch mechanism 400, the clutch is disengaged to enable decocking. If the user had already detached the arm 450 from the winch mechanism 400 after drawing the crossbow 10, then the arm 450 must be reattached before decocking the crossbow 10 as described above. If the user had already withdrawn the shaft 440 and the arm 450 from the crank aperture 104 after drawing the crossbow 10 (in examples wherein that is permitted), then the arm 450 and the shaft 440 must be reinserted through the crank aperture 104 before reattaching the arm 450 and decocking the crossbow 10 as described above.

In addition to the preceding, the following examples fall within the scope of the present disclosure or appended claims:

Example 1

A safety device for a crossbow, the safety device comprising a wrist strap and a crank aperture formed in a palm portion of the wrist strap, wherein: (a) the wrist strap is arranged so as to be secured around a user's wrist with the crank aperture positioned over a palm of the user's hand; and (b) the crank aperture is sized and positioned so as to (i) enable passage therethrough of a shaft of a crossbow crank but prevent passage therethrough of a handle of the crossbow crank, and (ii) with the wrist strap secured around the user's wrist, enable the user to grasp the handle with the shaft extending through the crank aperture away from the palm of the user's hand.

Example 2

The device of Example 1 wherein a dorsal-wrist portion of the wrist strap is divided into separate strap segments, and the separate strap segments are arranged so as to be (i) connected together to secure the wrist strap around the user's wrist and (ii) disconnected from one another to enable removal of the wrist strap from the user's wrist.

Example 3

The device of Example 2 wherein the dorsal-wrist portion of the wrist strap includes a buckle arranged so as to secure the wrist strap around the user's wrist and enable removal of the wrist strap from the user's wrist.

Example 4

The device of any one of Examples 1 through 3 further comprising the crossbow crank, wherein the crossbow crank comprises the handle, the shaft connected to the handle, and the arm connected to the shaft, wherein (i) the arm is rotatable relative to the handle about an axis defined by the shaft, (ii) the arm is structurally arranged so as to be attached to a winch mechanism of a crossbow and rotatable about an axis defined by the winch mechanism, thereby enabling operation of the winch mechanism, (iii) with the arm attached to the winch mechanism, the axis defined by the shaft is substantially parallel to and offset from the axis defined by the winch mechanism, and (iv) the arm is structurally arranged so as to be detachable from the winch mechanism.

Example 5

The device of any one of Examples 1 through 4 wherein the crank aperture is sized or arranged so as to enable passage therethrough of an arm of the crossbow crank.

Example 6

The device of Example 5 further comprising a substantially rigid grommet attached to the wrist strap, wherein the crank aperture is defined by the grommet.

Example 7

A method for operating a crossbow using the device of any one of Examples 5 or 6, the method comprising: (A) securing the wrist strap around one's wrist with the crank aperture positioned over a palm of one's hand; (B) inserting the arm and the shaft of the crossbow crank through the crank aperture so that, with the wrist strap secured around one's wrist, the handle is positioned against one's palm and the shaft extends through the crank aperture away from one's palm; (C) after parts (A) and (B), attaching the arm of the crossbow crank to the winch mechanism of the crossbow; and (D) after part (C), (i) grasping the handle and (ii) using the crossbow crank to operate the winch mechanism to draw the crossbow.

Example 8

The method of Example 7 further comprising: (E) after part (D), with the crossbow held in a drawn arrangement, releasing the handle of the crossbow crank; and (F) after part (E), with a bolt loaded onto the crossbow, aiming and triggering the crossbow to fire the crossbow, thereby launching the bolt from the crossbow.

Example 9

The method of Example 8 further comprising, after part (E) and before part (F), detaching the arm of the crossbow crank from the winch mechanism, wherein the crossbow crank remains suspended from the wrist strap during part (F).

Example 10

The method of Example 8 further comprising: (G) after part (E) and before part (F), detaching the arm of the crossbow crank from the winch mechanism; and (H) after part (G) and before part (F), withdrawing the shaft and the arm of the crossbow crank from the crank aperture and removing the crossbow crank from the wrist strap.

Example 11

The method of Example 7 further comprising, after part (D), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

Example 12

The method of Example 7 further comprising: (E) after part (D), (i) releasing the handle of the crossbow crank and (ii) detaching the arm of the crossbow crank from the winch mechanism; (F) after part (E), reattaching the arm of the crossbow crank to the winch mechanism; and (G) after part (F), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

Example 13

The method of Example 12 further comprising: (H) after part (E) and before part (F), withdrawing the shaft and the arm of the crossbow crank from the crank aperture and removing the crossbow crank from the wrist strap; (I) after part (H) and before part (F), reinserting the arm and the shaft of the crossbow crank through the crank aperture so that the handle is positioned against one's palm and the shaft extends through the crank aperture away from one's palm.

Example 14

The device of any one of Examples 1 through 4 wherein the crank aperture is sized or arranged so as to prevent passage therethrough of an arm of the crossbow crank, thereby retaining the crossbow crank secured to the wrist strap.

Example 15

The device of Example 14 further comprising a substantially rigid grommet attached to the wrist strap, wherein the crank aperture is defined by the grommet.

Example 16

The device of any one of Examples 14 or 15 further comprising a flange, bushing, or bearing arranged to retain the shaft secured to the wrist strap.

Example 17

The device of any one of Examples 14 through 16 wherein the shaft includes a circumferential groove or a reduced-diameter segment for receiving an inner edge of the crank aperture, thereby retaining the shaft secured to the wrist strap.

Example 18

A method for operating a crossbow using the device of any one of Examples 14 through 17, the method comprising: (A) securing the wrist strap around one's wrist with the crank aperture positioned over a palm of one's hand and with the handle positioned against one's palm with the shaft extending through the crank aperture away from one's palm; (B) after part (A), attaching the arm of the crossbow crank to the winch mechanism of the crossbow; and (C) after part (B), (i) grasping the handle and (ii) using the crossbow crank to operate the winch mechanism to draw the crossbow.

Example 19

The method of Example 18 further comprising: (D) after part (C), with the crossbow held in a drawn arrangement, releasing the handle of the crossbow crank; and (E) after part (D), with a bolt loaded onto the crossbow, aiming and triggering the crossbow to fire the crossbow, thereby launching the bolt from the crossbow.

Example 20

The method of Example 19 further comprising, after part (D) and before part (E), detaching the arm of the crossbow crank from the winch mechanism, wherein the crossbow crank remains suspended from the wrist strap during part (E).

Example 21

The method of Example 18 further comprising, after part (C), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

Example 22

The method of Example 18 further comprising: (D) after part (C), (i) releasing the handle of the crossbow crank and (ii) detaching the arm of the crossbow crank from the winch mechanism; (E) after part (D), reattaching the arm of the crossbow crank to the winch mechanism; and (F) after part (E), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A safety device for a crossbow, the safety device comprising a wrist strap, a crank aperture formed in a palm portion of the wrist strap, and a crossbow crank, wherein:

(a) the wrist strap is arranged so as to be secured around a user's wrist with the crank aperture positioned over a palm of the user's hand;

(b) the crossbow crank comprises a handle, a shaft connected to the handle, and an arm connected to the shaft, so that (i) the arm is rotatable relative to the handle about an axis defined by the shaft, (ii) the arm is structurally arranged so as to be attached to a winch mechanism of a crossbow and rotatable about an axis defined by the winch mechanism, thereby enabling operation of the winch mechanism, (iii) with the arm attached to the winch mechanism, the axis defined by the shaft is substantially parallel to and offset from the axis defined by the winch mechanism, and (iv) the arm is structurally arranged so as to be detachable from the winch mechanism; and (c) the crank aperture is sized and positioned so as to (i) enable passage therethrough of the shaft but prevent passage therethrough of the handle, and (ii) with the wrist strap secured around the user's wrist, enable the user to grasp the handle with the shaft extending through the crank aperture away from the palm of the user's hand.

2. The device of claim 1 wherein a dorsal-wrist portion of the wrist strap is divided into separate strap segments, and the separate strap segments are arranged so as to be (i) connected together to secure the wrist strap around the user's wrist and (ii) disconnected from one another to enable removal of the wrist strap from the user's wrist.

3. The device of claim 2 wherein the dorsal-wrist portion of the wrist strap includes a buckle arranged so as to secure the wrist strap around the user's wrist and enable removal of the wrist strap from the user's wrist.

4. The device of claim 1 wherein the crank aperture is sized or arranged so as to enable passage therethrough of the arm of the crossbow crank.

5. The device of claim 4 further comprising a substantially rigid grommet attached to the wrist strap, wherein the crank aperture is defined by the grommet.

6. A method for operating a crossbow using the device of claim 5, the method comprising:

(A) securing the wrist strap around one's wrist with the crank aperture positioned over a palm of one's hand;

(B) inserting the arm and the shaft of the crossbow crank through the crank aperture so that, with the wrist strap secured around one's wrist, the handle is positioned against one's palm and the shaft extends through the crank aperture away from one's palm;

(C) after parts (A) and (B), attaching the arm of the crossbow crank to the winch mechanism of the crossbow; and (D) after part (C), (i) grasping the handle and (ii) using the crossbow crank to operate the winch mechanism to draw the crossbow.

7. The method of claim 6 further comprising:

(E) after part (D), with the crossbow held in a drawn arrangement, releasing the handle of the crossbow crank; and (F) after part (E), with a bolt loaded onto the crossbow, aiming and triggering the crossbow to fire the crossbow, thereby launching the bolt from the crossbow.

8. The method of claim 7 further comprising, after part (E) and before part (F), detaching the arm of the crossbow crank from the winch mechanism, wherein the crossbow crank remains suspended from the wrist strap during part (F).

9. The method of claim 7 further comprising:

(G) after part (E) and before part (F), detaching the arm of the crossbow crank from the winch mechanism; and (H) after part (G) and before part (F), withdrawing the shaft and the arm of the crossbow crank from the crank aperture and removing the crossbow crank from the wrist strap.

10. The method of claim 6 further comprising, after part (D), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

11. The method of claim 6 further comprising:

(E) after part (D), (i) releasing the handle of the crossbow crank and (ii) detaching the arm of the crossbow crank from the winch mechanism;

(F) after part (E), reattaching the arm of the crossbow crank to the winch mechanism; and (G) after part (F), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

12. The method of claim 11 further comprising:

(H) after part (E) and before part (F), withdrawing the shaft and the arm of the crossbow crank from the crank aperture and removing the crossbow crank from the wrist strap;

(I) after part (H) and before part (F), reinserting the arm and the shaft of the crossbow crank through the crank aperture so that the handle is positioned against one's palm and the shaft extends through the crank aperture away from one's palm.

13. The device of claim 1 wherein the crank aperture is sized or arranged so as to prevent passage therethrough of the arm of the crossbow crank, thereby retaining the crossbow crank secured to the wrist strap.

14. The device of claim 13 further comprising a substantially rigid grommet attached to the wrist strap, wherein the crank aperture is defined by the grommet.

15. The device of claim 13 further comprising a flange, bushing, or bearing arranged to retain the shaft secured to the wrist strap.

16. The device of claim 13 wherein the shaft includes a circumferential groove or a reduced-diameter segment for receiving an inner edge of the crank aperture, thereby retaining the shaft secured to the wrist strap.

17. A method for operating a crossbow using the device of claim 14, the method comprising:

(A) securing the wrist strap around one's wrist with the crank aperture positioned over a palm of one's hand and with the handle positioned against one's palm with the shaft extending through the crank aperture away from one's palm;

(B) after part (A), attaching the arm of the crossbow crank to the winch mechanism of the crossbow; and (C) after part (B), (i) grasping the handle and (ii) using the crossbow crank to operate the winch mechanism to draw the crossbow.

18. The method of claim 17 further comprising:

(D) after part (C), with the crossbow held in a drawn arrangement, releasing the handle of the crossbow crank; and (E) after part (D), with a bolt loaded onto the crossbow, aiming and triggering the crossbow to fire the crossbow, thereby launching the bolt from the crossbow.

19. The method of claim 18 further comprising, after part (D) and before part (E), detaching the arm of the crossbow crank from the winch mechanism, wherein the crossbow crank remains suspended from the wrist strap during part (E).

20. The method of claim 17 further comprising, after part (C), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

21. The method of claim 17 further comprising:

(D) after part (C), (i) releasing the handle of the crossbow crank and (ii) detaching the arm of the crossbow crank from the winch mechanism;

(E) after part (D), reattaching the arm of the crossbow crank to the winch mechanism; and (F) after part (E), with the crossbow beginning in a drawn arrangement and with the wrist strap secured around one's wrist, (i) grasping the handle, with the handle positioned against one's palm and the shaft extending through the crank aperture away from one's palm, and (ii) using the crossbow crank to operate the winch mechanism to allow the crossbow to move from the drawn arrangement to an undrawn, brace arrangement without firing the crossbow.

* * * * *